United States Patent [19]

Hughes

[11] 4,113,341

[45] Sep. 12, 1978

[54] ELECTRICAL CONNECTOR HAVING PROVISION FOR CIRCUIT COMPONENTS

[75] Inventor: Donald Wayne Kent Hughes, Mechanicsburg, Pa.

[73] Assignee: AMP Incorporated, Harrisburg, Pa.

[21] Appl. No.: 824,023

[22] Filed: Aug. 12, 1977

[51] Int. Cl.[2] ..... H01R 19/34

[52] U.S. Cl. ..... 339/147 R; 339/192 RL; 339/222

[58] Field of Search ..... 339/147 R, 192 RL, 217 S, 339/222

[56] References Cited

U.S. PATENT DOCUMENTS

| | | | |
|---|---|---|---|
| 2,848,706 | 8/1958 | Besserer | 339/222 |
| 3,917,377 | 11/1975 | Hall et al. | 339/217 S X |

FOREIGN PATENT DOCUMENTS

| | | | |
|---|---|---|---|
| 1,007,275 | 3/1977 | Canada | 339/147 R |

*Primary Examiner*—Roy Lake

*Assistant Examiner*—E. F. Desmond

*Attorney, Agent, or Firm*—Frederick W. Raring

[57] ABSTRACT

An electrical connector for connecting wires to terminal pins or the like comprises a housing in which terminal members are contained. Each terminal member has a wire crimp portion at one end thereof and a pin receptacle portion at its other end, the two portions being integral with each other by means of a removable strap member. The wire crimp portion and the pin receptacle portion also has integral wire-receiving means for receiving the lead wires of a component. If a component is required to be connected in series with one wire in the connector, the leads from the component are inserted into the lead wire-receiving portions of the wire crimp portion and the pin receptacle portion of the terminal and the strap member is removed. For those wires extending to the connector which do not require a circuit component in series therewith, the strap member is not removed.

14 Claims, 6 Drawing Figures

2
18
96
94
102
100
24
98
10
8
12
6
4
19
14
84
78
76
74
82
56
86
34
48
30
16
32
22
90
88
36
42
92
38
20
40
25
21

ELECTRICAL CONNECTOR HAVING PROVISION FOR CIRCUIT COMPONENTS

BACKGROUND OF THE INVENTION

This invention relates to an electrical connector which serves to connect wires or other conductors to terminal pins or the like and which has provision for optionally connecting a circuit component in series with each wire. The herein disclosed embodiment of the invention is particularly intended to connect wires to contact pins in a refrigerator but other uses of the invention will be apparent to those skilled in the connector art.

Conventional domestic refrigerators are commonly produced with their compressor units contained in a sealed enclosure and the electrical connections to the compressor unit are achieved by means of contact pins which extend from a header which is mounted in the enclosure. The connectors which are used in the refrigeration industry for making connections to headers of this type must be relatively compact and particularly they must have a low profile because of the limited space available for their accommodation. They must also be extremely reliable because of the fact that they are required to give years of service without maintenance or other attention.

In the past, the circuitry for refrigeration compressors required three wires and the headers used were, therefore, provided with three contact pins. The connectors which have been developed for refrigeration compressors thus had three terminals therein which served to connect the wires directly to the contact pins. Electrical connectors of this general type are shown, for example, in U.S. Pat. Nos. 2,875,426, 3,231,849, and 3,777,302.

More recently, control circuits for refrigeration compressors have been developed which require only two conductors with a diode in series with one of these conductors and the three position connectors of the prior art are not suitable for these more modern compressors. Rather, a connector is required which provides a means for incorporating the diode in series with one of the conductors and which otherwise satisfies the requirements of connectors for refrigeration compressors.

In accordance with the principles of the instant invention, there is provided a connector comprising a housing which is dimensioned to receive two terminal members. Each terminal member has a wire crimp portion which is crimped onto the end of a wire and a pin receptacle portion which receives the contact pin which extends from a header of a compressor enclosure. The wire crimp portion and the pin receptacle portion are spaced-apart and are connected by an integral strap member. The wire crimp and pin receptacle portions of each terminal have a lead wire-receiving means which is adapted to receive a lead wire extending from a diode located between the crimp portion and the receptacle portion. This feature permits the diode to be connected in series with one of the wires by inserting its lead wires into the lead wire-receiving members and removing the strap. The wire extending to the connector which is to be connected directly to a contact pin is simply crimped onto an identical terminal member and the connecting strap is not removed.

It is accordingly an object of the invention to provide an electrical connector for connecting wires to contact members and permitting the incorporation of a diode or other circuit component into one of the circuits. A further object is to provide an improved connector for pin headers of the type used in refrigeration compressor enclosures. A further object is to provide a compact and reliable connector having a minimum number of parts.

These and other objects of the invention are achieved in a preferred embodiment thereof which is briefly described in the foregoing abstract, which is described in detail below, and which is shown in the accompanying drawing in which.

Figures 1, 2:
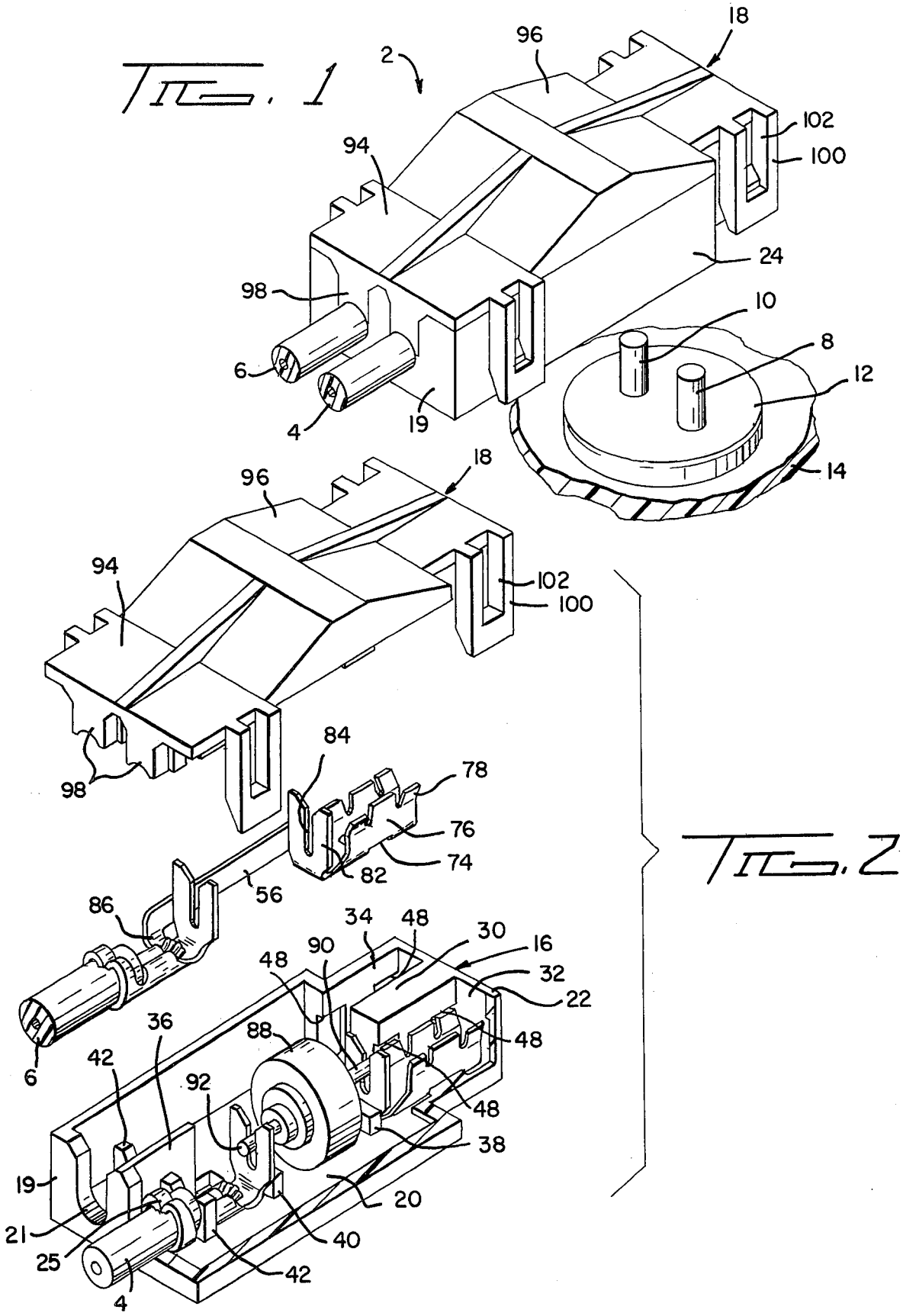
FIG. 1 is a perspective view of a connector assembly in accordance with the invention.
FIG. 2 is a perspective exploded view, partially in section, showing the various parts of the connector assembly.
Figure 3:
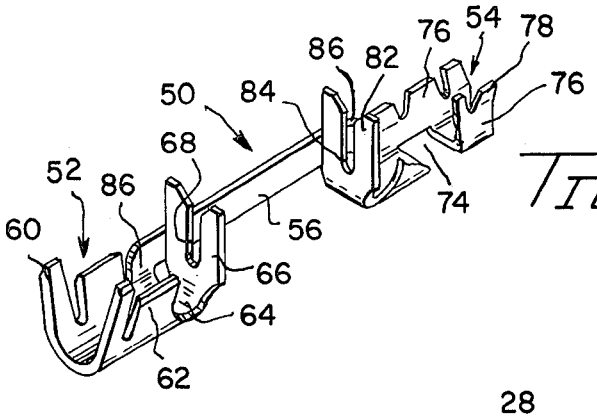
FIG. 3 is a perspective view of an uncrimped terminal member.
Figure 4:
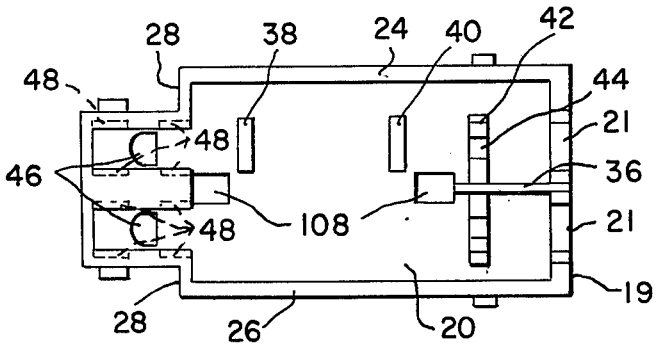
FIG. 4 is a plan view of the housing body.
Figure 5:
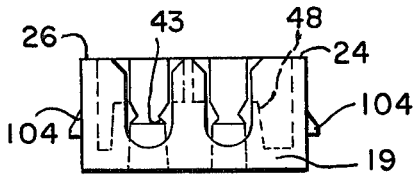
FIG. 5 is an end view of a housing body.
Figure 6:
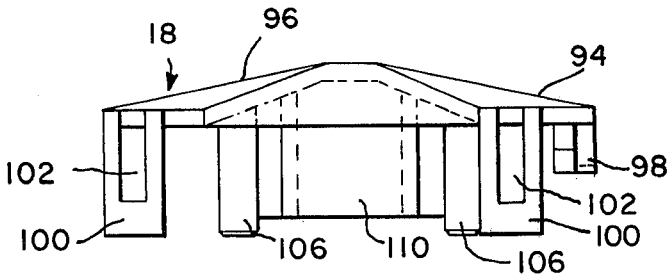
FIG. 6 is a side view of the housing cover.

A connector assembly 2 in accordance with the invention serves to connect first and second wires 4, 6 to first and second terminal pins 8, 10 which extend from a header 12 which, in turn, is mounted in the wall of an enclosure 14. The enclosure may contain a refrigeration compressor and the wires 4, 6 serve as the control circuits and power supply for the compressor.

The connector assembly 2 comprises generally a prismatic housing body 16 and a housing cover 18 which is assembled to the body after the terminals and the diode have been positioned in the body. The housing body 16 is advantageously of a molded insulating material and has a floor or base 20 from which sidewalls 19, 22, 24, and 26 extend. These sidewalls define an enclosure in which the ends of the wires, the terminals, and the diode are contained as shown in FIG. 2. A first sidewall 19 serves as a wire-receiving sidewall and has spaced-apart wire-receiving notches 21 extending downwardly from its upper edge. The second sidewall 22 is opposite to the sidewall 19 and the additional sidewalls 24, 26 extend along the sides of the base as shown. The sidewalls 24, 26 are inwardly offset as shown at 28 so that the right hand end of the housing body is relatively more narrow than the wire-receiving end.

An internal barrier wall 30 extends from the sidewall 22 partially towards the wire-receiving sidewall 19 and this barrier wall defines two side-by-side stalls 32, 34 which receive the pin receptacle portions 54 of the terminal members. Openings 46 are provided in the base 20 in the vicinity of these stalls to permit entry of the contact pins 8, 10 and downwardly facing shoulders 48 are provided on the sides of these stalls for cooperation with retention ears of the pin receptacle members 54 as will be described below.

There is also provided a barrier wall 36 which extends from the internal surface of wire-receiving sidewall 19 and towards the barrier wall 30. This latter barrier wall 36 provides two side-by-side stalls which receive the ends of the wires 4, 6 and crimp portions of the terminal members 52. Spaced-apart bosses 38, 40 are provided on the base 20 adjacent to the stall 32 and intermediate the ends of the housing and serve as stops or locating means for portions of the terminals as shown in FIG. 2 and as described more fully below. A relatively high boss 42 is provided on each side of the barrier wall 36 and these bosses 32 have notches extending inwardly from their upper ends which receive the wire crimps on the ends of the wire 4, 6. These notches are constricted as shown at 43 adjacent to their upper ends so that the crimped terminals can be moved downwardly into the notch, but upward movement of the terminals will be restrained.

The terminal members 50 comprise a wire crimp portion 52 and a pin receptacle portion 54, these two portions of the terminal members being axially aligned and spaced-apart as shown and are connected to each other by an integral strap member 56. These terminal members are manufactured by stamping and forming of conductive sheet metal and are produced as an endless strip for maximum economy. The wire crimp portion 52 of each terminal member comprises a common web 58 having the one end thereof upstanding sidewalls 60 which are intended for crimping onto the insulation of a wire as shown in FIG. 2. Sidewalls 62 are also provided for crimping onto the conducting core of a wire and establishing electrical contact therewith. The web 58 has an extension 64 which projects from the end of the wire core crimp portion and a lead wire-receiving plate member 66 extends upwardly, as viewed in FIG. 2, from the end of this web extension. The lead wire-receiving portion has a wire-receiving slot 68 extending downwardly from its upper free end so that the lead of the diode can be connected to the terminal member by merely moving the lead into this wire-receiving slot.

The pin receptacle portion 54 is also generally U-shaped having a web 72 and sidewalls 76 extending from its side edges. An opening 74 is provided in the web for reception of a contact pin and the opposed surfaces of the sidewalls 76 are spaced-apart by a distance such that they will establish electrical contact with an inserted pin. Retention ears 78 are struck outwardly from the corners of the sidewalls and these ears lodge against the previously identified shoulders 48 in the stalls 32, 34 to retain the pin receptacle portions of the terminal members in the stalls.

Pin receptacle portion 54 also has a web extension 80 and a lead wire-receiving means as previously described at 66 integral therewith. The connecting strap 56 is integral with laterally extending ears 86 of the two web extensions 64, 80 and this strap is bent upwardly to minimize the width of the terminal member.

As shown in FIG. 2, the diode 88 is generally cylindrical and has lead wires 90, 92 extending from its ends. It should be mentioned at this point that careless manipulation of these lead wires will quite often result in damage to the diode 88 and these wires must, therefore, be protected against bending or other abuse when the diode is located in the housing.

In use, the wire crimp portion 52 of a terminal member 50 is crimped onto the stripped end of the wire 4 and the connecting strap portion of this terminal member is then removed by simply shearing across the ear portions 86. The wire crimp portion is then positioned in the stall on the right as viewed in FIG. 2 of the barrier wall 36 and the pin receiving portion 54 is positioned in the stall 32 by moving this pin receptacle downwardly into the stall until the ears lodge beneath the shoulders 48. The lead wires 90, 92 of the diode 88 are then trimmed and the diode is positioned between the lead wire-receiving portions 66, 82 with the lead wires themselves disposed in the wire-receiving slots of these lead like members. It will be noted that the plate-like wire-receiving members are disposed against the bosses 38, 40 and that the pin receptacle portion 54 is further restrained against movement parallel to the axes of the lead wires 90, 92 by internal surfaces of sidewall 32 and between shoulders 48. Finally, the rearwardly facing edge 25 of the insulation crimp portion 60 of the terminal is substantially against the internal surface of the sidewall 19 so that if a tensile force is applied to the wire 4, this tensile force will not be transmitted to the diode lead 92.

The wire 6 is connected to the wire crimp portion 52 of another terminal member 50 and this terminal member is simply moved downwardly from the position shown in FIG. 2 so that its pin receptacle portion 54 is disposed in the stall 34 and the wire crimp portion is disposed in the stall on the left of the barrier wall 36.

After the wires, the terminal members, and the diode have been positioned in the enclosure defined by the sidewalls of the housing body, the cover member is simply assembled to the housing body by downward movement thereof from the position shown in FIG. 2. The cover member 18 has an external upper surface 94 and a central upwardly arched section 96 which provides internal clearance in the diode 88 which projects above the upper edges of the sidewall in the housing body. On its underside, the cover member has depending clamping portions 98 which are dimensioned to enter the notches 21 in the wire-receiving sidewall 19 and which have lower ends which bear against the insulation of the wires 4, 6. This feature provides added strain relief means for the wires and minimizes the transmission of any tensile forces which may be applied to the wires. The cover member is secured to the housing body by depending latch arms 100 which have openings 102 therein and these openings are dimensioned to receive latching ears 104 which project from the external surface of the housing body.

Arms 106 extend downwardly from the underside of the cover member and are received in openings 108 in the connector body portion 20. The openings 108 are adjacent to the barrier walls 30, 36 and an additional barrier wall 110 is integral with the cover member and extends between the depending arms 106. Barrier wall 110 is laterally offset in its central portions as shown to provide clearance for the cylindrical portion of the circuit component 88. The barrier wall 110, the arms 106, and the barrier walls 30, 36 in the connector body all cooperate to divide the interior of the housing into two separate compartments which is desirable from an electrical standpoint.

A connector in accordance with the invention satisfies all the requirements of compactness and reliability as described above and as required in connectors used for the pin headers mounted in compressor enclosures. A distinct advantage of the invention is that only two identical terminal members 50 are required for each connector although one of the terminal members serves to connect the diode 88 in series with one of the conductors. It will be apparent that this feature of permitting optional incorporation of a diode can be used under other circumstances where circuit components are wired in series with conductors extending to a connector.

What is claimed is:

1. An electrical connector means for disengageably connecting a conductor to an external terminal member and for optionally connecting a circuit component in series with said conductor, said connector means comprising:

an insulating housing, a connector terminal member, said connector terminal member comprising a conductor connecting portion and a mating portion, said mating portion being dimensioned to be mated with said external terminal member, said conductor connecting portion having means for securing said conductor thereto, removable connecting strap means integral with, and extending between, said conductor connecting portion and said mating portion, first and second lead wire-receiving means integral with said conductor connecting portion and said mating portion, each of said lead wire-receiving means comprising a plate like member having a lead wire-receiving slot extending therein, said housing having terminal member receiving portions which are capable of receiving said terminal member when said connecting strap is integral therewith and capable of separately receiving said conductor connecting portion said mating portion, and a circuit component positioned between said conductor connecting and said mating portions with the lead wires of said component received in said lead wire connecting means.

2. An electrical connector means as set forth in claim 1, said conductor connecting portion and said mating portion of said terminal member being an axially aligned spaced-apart relationship, said first and second lead wire-receiving means being integral with the proximate ends of said conductor connecting portion and said mating portion.

3. An electrical connector means as set forth in claim 1, said conductor connecting portion and said mating portion being generally U-shaped and having inner ends which are proximate to each other, said strap means being integral with said inner ends said first and second lead wire-receiving means extending from said inner ends.

4. An electrical connector means as set forth in claim 3, said connector means comprising a plurality of said connector members.

5. An electrical connector means as set forth in claim 4, said housing comprising a housing body having sidewalls extending therefrom, a first one of said sidewalls constituting a conductor receiving sidewall, a second one of said sidewalls being opposite to said first sidewall, at least one barrier wall extending from said second sidewall towards said first sidewall, said barrier wall defining side-by-side stalls, said stalls being dimensioned to receive said mating portions of said terminal members, said housing body providing clearance for said circuit component between said first and second sidewalls.

6. An electrical connector means as set forth in claim 5, having separate cover means for assembly to said housing body.

7. An electrical connector for connecting first and second wires to first and second terminal pins and for connecting a diode in series with said first wire, said connector comprising:

an insulating housing having a base and having sidewalls extending from said base, said sidewalls defining an enclosure, a first one of said sidewalls constituting a wire-receiving sidewall, said wires extending through said first sidewall, a second sidewall which is opposite to said first sidewall, an internal barrier wall extending from said second sidewall towards said first sidewall said barrier wall defining first and second side-by-side stalls, first and second receptacle terminals in said first and second stalls, each of said receptacle terminals having a receptacle portion which is adapted to receive one of said contact pins, said first receptacle terminal having an integral lead wire-receiving portion at the end thereof which is remote from said second sidewall, first and second wire terminals connected to said first and second wires respectively, said first and second wire terminals being adjacent to said first sidewall, said first wire terminal having a lead wire-receiving portion which is spaced from said lead wire-receiving portion of said first receptacle terminal, said diode being disposed between said lead wire-receiving portions of said first wire terminal and said first receptacle terminal, said diode having leads extending therefrom, said leads being received within said lead wire-receiving portions of said first wire terminal and said first receptacle terminal whereby said diode is connected in series with said first wire, and strip metal connecting strap means integral with said second wire terminal and said second receptacle terminal.

8. An electrical connector as set forth in claim 7, said first wire terminal being identical to said second wire terminal, said first receptacle terminal being identical to said second receptacle terminal.

9. An electrical connector as set forth in claim 8, said first and second wire terminals being crimped onto said first and second wires respectively.

10. A stamped and formed electrical terminal means intended for connecting a wire to a terminal pin or the like comprising:

a wire connecting portion and a pin receptacle portion, said portions being in axially aligned spaced-apart relationship to each other, said portions having inner ends which are proximate to each other, said wire connecting portion and said pin receptacle portion each having a lead wire-receiving portion integral with its said inner end, a connecting strap portion extending between, and integral with, said inner ends, whereby, said terminal means can be used to connect a wire directly to a terminal pin by connecting said wire connecting portion onto said wire and mating said receptacle portion with said pin, and said terminal means can be used to connect said wire to a terminal pin with a circuit component in series with said wire by inserting the leads of said component into said lead wire-receiving portions, removing said connecting strap, and mating said receptacle portion with said pin.

11. A stamped and formed terminal means as set forth in claim 10, said lead wire-receiving portions each comprising a plate-like member having a free end and having a lead wire-receiving slot extending therein from said free end.

12. A stamped and formed terminal means as set forth in claim 10, said wire connecting portion and said pin receptacle portion each being generally U-shaped and comprising a web and sidewalls extending from said web, said sidewalls of said wire connecting portion being intended for crimping onto a wire positioned therebetween, said web of said pin receptacle portion having an opening therein for reception of said contact pin, said sidewalls of said pin receptacle portion having opposed surfaces which contact said pin.

13. A stamped and formed terminal means as set forth in claim 12, said lead wire-receiving portions each comprising a plate-like member having a free end and a fixed end, a lead wire-receiving slot extending inwardly from said free end, said fixed ends being integral with said webs of said wire connecting portion and said pin receptacle portion.

14. A stamped and formed terminal means as set forth in claim 13, said connecting strap portion having ends which are integral with said webs of said wire connecting portion and said pin receptacle portion.

* * * * *